United States Patent [19]

Pearson et al.

[11] Patent Number: 4,784,418

[45] Date of Patent: Nov. 15, 1988

[54] DOOR LATCH HANDLE FITTINGS AND RETAINERS THEREFOR

[75] Inventors: Arthur Pearson, Halesowen; Jack Longville, West Bromwich, both of United Kingdom

[73] Assignee: George Salter & Co., Ltd., West Midlands, England

[21] Appl. No.: 763,326

[22] Filed: Aug. 7, 1985

Related U.S. Application Data

[63] Continuation of Ser. No. 430,650, Sep. 30, 1982, abandoned.

[30] Foreign Application Priority Data

Oct. 1, 1981 [GB] United Kingdom ..... 8129720

[51] Int. Cl.[4] ..... F05B 3/00

[52] U.S. Cl. ..... 292/348; 24/681; 292/353; 292/357; 411/525

[58] Field of Search ..... 292/347–349, 292/353, 356, 357, 358, 336.3, DIG. 53, DIG. 61, DIG. 64; 411/521, 526, 525, 528; 24/681, 662

[56] References Cited

U.S. PATENT DOCUMENTS

| | | | |
|---|---|---|---|
| 1,446,587 | 2/1923 | Russell | 292/348 |
| 1,548,581 | 8/1925 | Crum | 292/348 |
| 2,702,720 | 2/1955 | Young | 292/357 |
| 4,042,268 | 8/1977 | Coglan | 292/347 |
| 4,065,165 | 12/1977 | Hamblin | 292/348 |

FOREIGN PATENT DOCUMENTS

| | | | |
|---|---|---|---|
| 1272162 | 7/1968 | Fed. Rep. of Germany | 292/348 |
| 1194908 | 5/1959 | France | 292/336.3 |
| 258186 | 4/1928 | Italy | 292/348 |
| 96789 | 9/1960 | Norway | 292/348 |
| 257341 | 4/1949 | Switzerland | 292/348 |
| 577552 | 5/1946 | United Kingdom | 292/349 |
| 812200 | 4/1959 | United Kingdom . | |
| 892851 | 4/1962 | United Kingdom . | |
| 963796 | 7/1964 | United Kingdom | 292/336.3 |
| 1305269 | 1/1973 | United Kingdom | 292/347 |
| 1465910 | 3/1977 | United Kingdom . | |
| 1486739 | 9/1977 | United Kingdom . | |
| 1496934 | 1/1978 | United Kingdom | 292/356 |
| 1564250 | 4/1980 | United Kingdom | 292/336.3 |
| 2109853 | 6/1983 | United Kingdom | 292/336.3 |

*Primary Examiner*—Lloyd A. Gall
*Attorney, Agent, or Firm*—Neil F. Markva

[57] ABSTRACT

A door latch lever handle fitting includes a retaining member which is pushed onto a shank portion of a lever handle. The retaining member has tongues which engage flats of the shank portion and tongues which engage in grooves formed in the surface of the shank portion to thereby grip the shank portion. In other embodiments where there are no grooves, different retaining members have modified gripping tongue arrangements. The retaining member is stressed to give axial thrust to take up any residual play in the assembly. Ears of the retainer member are engageable with an abutment lug on the rear face of a base plate of the assembly so that the door handle may be turned through a predetermined angle.

25 Claims, 3 Drawing Sheets

FIG. 1.
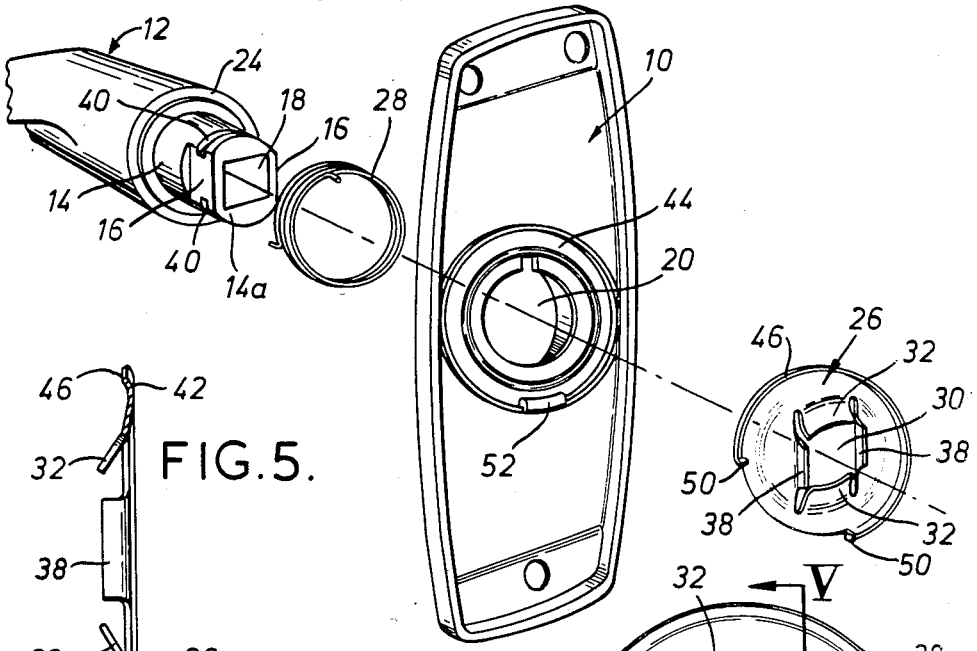
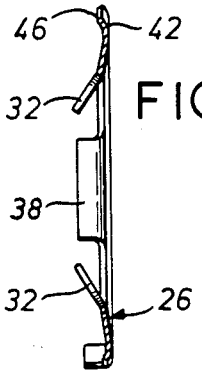
FIG. 5.
FIG. 4.
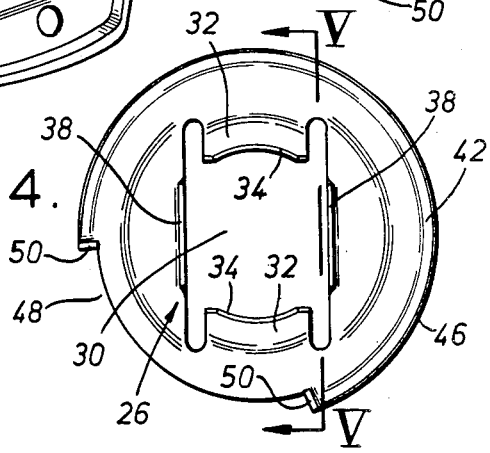
FIG. 2.
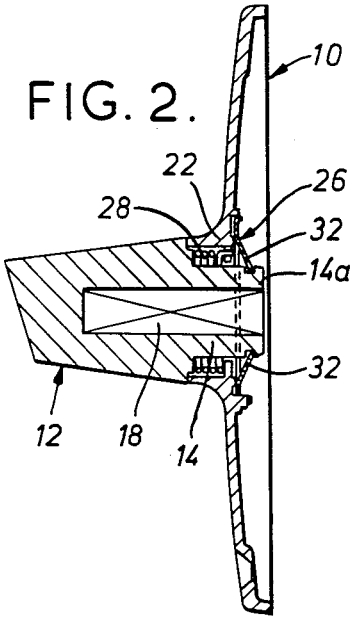
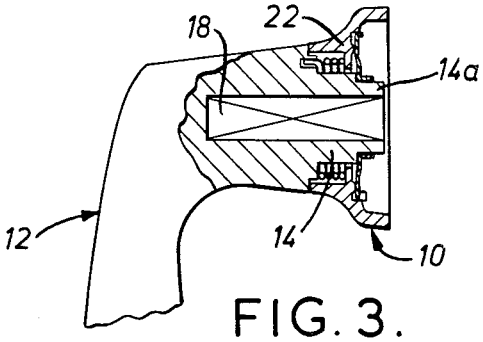
FIG. 3.

DOOR LATCH HANDLE FITTINGS AND RETAINERS THEREFOR

This is a continuation of application Ser. No. 430,650, filed Sept. 30, 1982, now abandoned.

FIELD OF THE INVENTION

This invention relates to the construction of door latch handle fittings, particularly such fittings of the type comprising a spring biased lever handle having a shank portion rotatably mounted in a rear base plate adapted to be secured to the face of the door, the shank portion being adapted operatively to engage at its rear end a latch bolt operating spindle and being fitted with retaining means for securing the handle to said base plate.

BACKGROUND OF THE INVENTION

In a commonly used construction for such door latch handle assemblies, the shank portion comprises a reduced diameter portion which extends through a bearing aperture in the base plate so that a front face portion of the latter locates against a shoulder at the inner end of the reduced diameter shank portion. The rear section of the shank portion which projects through the base plate aperture has a non-circular cross-section and is fitted with a flat keeper plate or stop plate together with a circlip retaining element which is engaged in a groove or grooves adjacent the rear free end of the shank. The stop plate is arranged to turn with the shank portion and includes stop surfaces arranged to cooperate with abutment means on the base plate (1) for locating the angular position so that the lever part normally extends horizontally and (2) for limiting its angular movement. Although widely used, this known construction has the disadvantage that the retaining means comprises two separate parts, the stop plate and the circlip, which must be separately fitted. Furthermore manufacturing tolerances often produce undue axial play in the handle when the circlip is fitted.

An object of the present invention is to provide an improved form of retaining means for effectively fixing the handle to the base plate which can facilitate assembly and reduce production costs.

SUMMARY OF THE INVENTION

According to the invention, in a door latch lever handle fitting of the type referred to, the retaining means comprises a single spring steel retainer member having a plate-like form with an aperture of non-circular contour. Integrally formed gripping tongues are inclined inwardly and rearwardly toward the central axis and around the periphery of the aperture to permit the retainer member to be pushed onto the rear, free end of the shank portion which has a cross-sectional profile co-operable with said non-circular contour of the aperture. Thus, the shank portion can be gripped by said tongues to restrain removal therefrom and rotation relative thereto. The retainer member has a rim or outer peripheral portion having a bearing surface for bearing against the rear face of the base plate. Thus, when the fitting is assembled, the rim or outer peripheral portion is urged to bear against the base plate thereby stressing the retainer member to give axial thrust and urge the shank portion toward the base plate. The retainer member also includes stop surfaces arranged to co-operate with abutment means for locating the normal angular position of the handle and for limiting the angular member thereof with respect to the base plate.

The spring steel retainer member therefore fulfils the function of both the stop plate and circlip of the conventional prior art fittings hereinbefore mentioned. The retainer member may have a dished configuration and, in conjunction with an inherent resiliency derived from the spring steel material, this enables it to provide an axial force which can take up axial play arising from manufacturing tolerances even when the axial position of the retainer is located by a preformed groove in the shank portion.

Thus, in one preferred embodiment, the retainer member is in the form of a circular disc made of spring steel which has a dished configuration and which has a central non-circular aperture of substantially rectangular form to accommodate a substantially rectangular non-circular cross-section of the rear section of the shank portion of the handle. The main pair of inclined integral gripping tongues extend inwardly and rearwardly from the shorter sides of the rectangular opening and additional upstanding short tongues or lugs extend rearwardly from the longer sides of the rectangular opening to closely embrace the corresponding sides of the shank portion. Also, the rim portion is preferably formed with a shallow upturned circumferential flange but this is cut away throughout a sector of predetermined angular extent so that shoulders are formed at opposite ends of the cut-away portion to provide the stop surfaces for co-operating with an abutment stop lug on the rear face of the base plate. These shoulders are preferably defined by short integral upturned extensions of the rim portion forming rearwardly directed ears having flat faces lying in radial planes.

BRIEF DESCRIPTION OF DRAWINGS

By way of example, embodiments of the invention are illustrated in the accompanying drawings and will be more particularly described with reference thereto.

FIG. 1 is an exploded perspective view of the door latch lever handle assembly fitting of a first embodiment;

FIG. 2 is a longitudinal cross-sectional view through the base plate of the assembled fitting showing the handle fixed in position;

FIG. 3 is a fragmentary transverse cross-section through the base plate of the assembly with the handle fixed in position;

FIG. 4 is a rear elevation of the retainer element which is used to fix the handle to the base plate, shown on a larger scale;

FIG. 5 is a cross-sectional view on line V—V of FIG. 4;

FIG. 10*a* being a sectional view of the retainer, taken on the line Xa—Xa of FIG. 10*b*.

DETAILED DESCRIPTION

Figure 6:
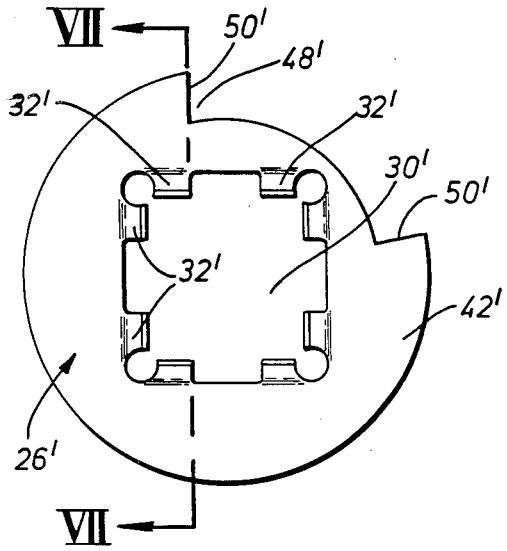
FIG. 6 is a view similar to FIG. 4 showing another form of retainer for use with a different form of door latch lever handle assembly of the same general type.

Referring to the drawings, the door latch lever handle fitting comprises a die-cast hollow base plate 10, a die-cast lever handle 12 provided at its inner end with a rearwardly extending reduced diameter shank portion 14. The rearmost free end portion 14*a* is formed with flat side faces 16 to provide a non-circular cross-section of substantially rectangular form. A square-sectioned axial hole 18 also extends into the shank portion for receiving the usual square-section latch operating handle.

In fitting the lever handle 12 to the base plate 10, the shank portion 14 passes through central aperture 20 of a bearing boss 22 of base plate 10. An annular shoulder 24 at the inner end of shank portion 14 seats against a front bearing face of the boss 22. Handle 12 is fixed in position by a retaining member 26 within the hollow interior of base plate 10 as hereinafter described. A torsion coil spring 28 is also accommodated within the aperture 20 to provide a spring return bias.

As shown, the retaining member 26 comprises a circular disc of spring steel having a dished configuration with a central aperture 30 of substantially rectangular configuration. A pair of opposed integral gripping tongues 32, extend inwardly and rearwardly from the shorter sides of the aperture 30 to be inclined towards the central axis. Gripping tonges 32 have free edges 34 with a slightly arcuate contour matching the surface curvature of the shank portion 14 of the handle. The longer sides of the aperture 30 are flanked by a pair of additional short upstanding flat tongues or lugs 38, bent to extend rearwardly and having a straight free edge adapted to engage closely against the flats 16 of the shank portion 14 thereby to ensure that the retainer member 26 turns with the handle. Closely adjacent the rearward extremity of the shank portion 14, the non-circular portion 14*a* is formed with a pair of circumferentially extending grooves 40 in its curved surface portions for receiving the gripping tongues 32.

This arrangement permits the retainer member 26 to be pushed onto the free end portion 14*a* of shank portion 14 after the handle 12 has been fitted to the base plate 10. Thus, tongues 32 are flexed outwardly and ride over the surface until they engage within the groove portions 40 to grip shank portion 14 and prevent removal. At the same time, the short side tongues or lugs 38 engage the flats 16 to prevent any relative rotational movement between shank portion 14 and retainer member 26.

Clearly, axial pressure is applied in fitting retainer member 26 when engaging tongues 32 in groove portions 40. Rim portion 42 of retainer member 26 bears against a circular bearing surface 44 of the rear surface of base plate 10. The disc of retainer member 26 is slightly stressed in this condition and acts somewhat as a "Belleville" washer to give axial thrust which will take up any residual play in the assembly.

To provide a smooth bearing surface on retainer member 26, the rim portion 42 is slightly curved in radial cross-section to form a shallow upturned circumferential flange 46 directed rearwardly.

To provide stop means, part of the rim portion 42 is cut away through a sector of pre-determined angular extent to form a gap 48 bounded at opposite ends by shoulders or ears 50 formed by short integral upturned extensions of the rim portion 42. Ears 50 are directed rearwardly and have flat stop surfaces, lying in radial planes, adapted to engage opposite ends of an abutment lug 52 integrally formed on the rear face of the base plate 10 to locate the spring-biased handle in its out-of-use position and limit its angular movement. Stop surfaces provided by ears formed in this manner can be stronger and more satisfactory than stop surfaces provided by simple edge surfaces when using thin spring steel sheet to fabricate the retainer member 26.

Thus, retainer member 26 fulfills the dual functions of both fixing handle 12 to base plate 10 and of providing the required stop means. Member 26 also exerts an axial thrust which will take up any residual axial play in the mounting of the handle 12. Moreover, assembly and production is greatly facilitated in that, after fitting handle 12 to base plate 10, only a single straightforward opertion is needed to push the retainer member 26 onto shank portion 14 and the handle 12 is thereby fixed and secure.

Figure 7:
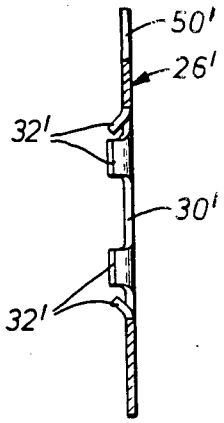
FIG. 7 is a cross-sectional view on line VII—VII of FIG. 6.

In a modified form, retainer 26' shown in FIGS. 6 and 7 is designed for use in a door latch lever handle assembly where the shank portion has a square cross-sectional shape without any locating peripheral groove. This retainer 26' again comprises a disc of spring steel having a central aperture 30' with a square configuration to match the corresponding shank portion. Integral inclined gripping tongues 32' extend inwardly and rearwardly from the sides of the aperture 30'. In this case, however, there are a pair of such tongues 32' in spaced relationship along each of the four sides of the aperture 30'. Retainer 26' may be flat or only slightly dished since it can be pushed on to the shank under an axial pressure as far as is necessary to take up any axial play and it is then held in its set position by the tongues 32' which will bite into and grip the corresponding shank portion surface. The rim portion 42' provides part of the bearing surface and is again cut away to form a gap 48' defining abutment shoulders 50' for engaging an abutment stop on the base plate 10 as before described. However, shoulders 50' are here formed by plain edge surfaces since a heavier gauge of sheet metal is used for the retainer 26'.

Figure 8:
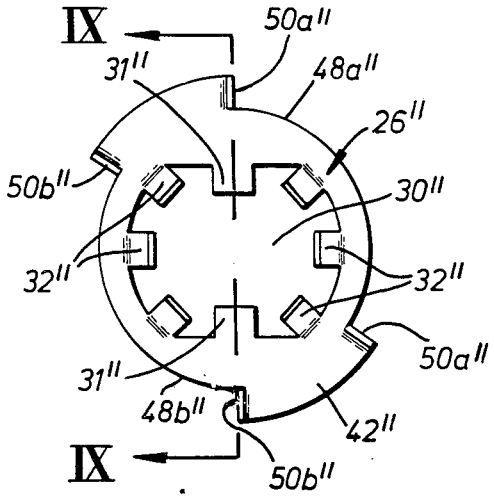
FIG. 8 is a view similar to FIG. 4 showing another form of retainer for use with a different form of door latch lever handle assembly of the same general type.
Figure 9:
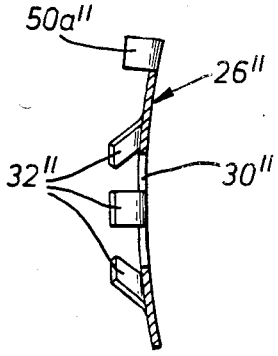
FIG. 9 is a cross-sectional view on line IX—IX of FIG. 8.

In another modified form, retainer 26" shown in FIGS. 8 and 9 having a central aperture 30" is shaped to define a pair of flat lugs 31" directed inwards to engage within radial slots provided in a corresponding shank portion of the handle for which this particular retainer is designed. A plurality of integral, inclined gripping tongues 32" are spaced around the periphery of aperture 30" for gripping the shank portion. Also, a rim portion 42" is cut away to form two gaps 48*a*" and 48*b*" providing two pairs of shoulders formed by upturned ears (as in the first embodiment) 50*a*" and 50*b*" for engaging a pair of spaced stops on the base plate.

Figure 10A:
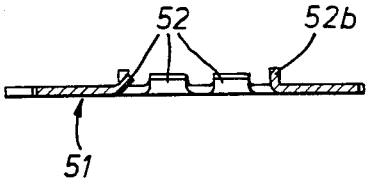
FIGS. 10*a* and 10*b* are views showing yet another form of retainer.
Figure 10B:
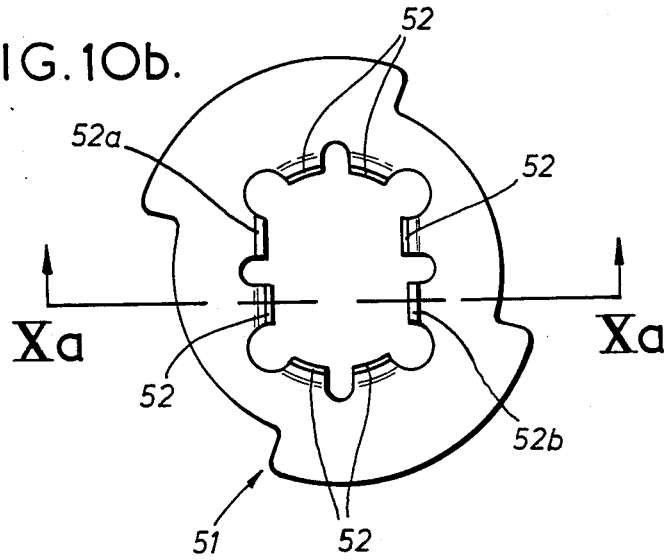

FIGS. 10*a* and 10*b* show a further modified form of retainer 51 which has proved extremely successful under rigorous testing. The retainer 51 is substantially flat and has eight tongues 52, six of which are inclined rearwardly at a suitable angle (for example, 45°) to bit into the shank (see FIG. 10*a*). In testing, the retainer 51 was used on a shank portion without a pre-formed groove. Most importantly two offset teeth 52*a*, 52*b* are set at a different angle to the others and this angle is at 90° to the plane of the retainer 51. The retainer is pushed over the shank portion and stressed into a dished configuration so that an outside edge of the retainer 51 bears against the base plate and gives the required axial thrust. If all the tongues 52 are arranged at the same angle during rigorous testing the tongues bite into the shank portion and gradually wear grooves therein until there is some play between the retainer and shank portion. As the handle returns to its normal position from a displacement the retainer 51 hits an appropriate abutment on the base plate, stopping the plate, and the shank portion tends to continue to turn so that the tongues bite into the shank portion. In particular opposed tongues 52*a* and 52*b* would tend to bite into the shank portion if at the same angle as others. Providing a larger surface contact area by increasing the rearward angle of tongues 52*a* and 52*b* until they lie flat against respective flats of the shank portion, reduces this undesirable effect so that retainer member 51 necessarily turns with the handle and door handle assemblies may be produced which easily come within British Standards testing both for domestic and commercial door handles. Domestic requirements may be met even with all the tongues at the same angle.

Retainer 51 is also particularly suited to present assembly tools used for "pushing" the retainer onto a shank portion. The number and size of teeth and the relative dimensions apparent from FIGS. 10*a* and 10*b* are considered particularly advantageous. The retainer 51 is of heavy gauge metal.

It is to be understood that the invention provides retainers which are mirror images of all the retainers shown so that both left and right-handed door fittings may be provided.

We claim:

1. In a door latch lever handle fitting having a base plate and a lever handle including retaining means for rotatably securing a shank portion of the handle having a rear end to the base plate which is adapted to be secured to the face of a door, said retaining means comprising:

(a) a single, spring steel retainer member having a plate-like form including a shank portion contacting aperture periphery which fits over the shank portion of the handle, (b) said retainer member including at least four tongues inclined rearwardly from said periphery including gripping tongues inclined inwardly from said periphery toward the central axis of said aperture, (c) said gripping tongues being pre-bent out of the general plane of the retainer member prior to assembly of said retainer member on said shank portion to permit said retainer member to be pushed onto said rear end of the shank portion, (d) said shank portion having a cross-sectional profile co-operable with said aperture periphery of said retainer member so that the shank portion is capable of being gripped by said tongues to restrain removal therefrom and prevent relative rotation between the shank portion and the retainer member, (e) said retainer member including a rim portion having a bearing surface which biasingly engages the base plate with an axial thrust when said fitting is assembled with the inwardly and rearwardly inclined tongues of the retainer member gripping the shank portion of the handle to urge the shank portion toward the base plate, (f) said fitting including abutment means and said retainer means including stop surfaces arranged to co-operate with the abutment means to locate the normal angular position of the handle and to limit the angular movement thereof with respect to the base plate.

2. In a door latch fitting as defined in claim 1, wherein the shank portion includes a groove formed along its outer surface to receive said inwardly inclined gripping tongues, and the axial position of the retainer member is to be located by the groove in the shank portion.

3. In a door latch fitting as defined in claim 1, wherein a pair of opposing gripping tongues extend inwardly to be inclined toward a central axis of the retaining member to provide said axial thrust and to restrain removal of the retainer member.

4. In a door latch fitting as defined in claim 3 wherein another pair of gripping tongues extend rearwardly to engage the shank portion to prevent relative rotation between the shank portion and the retainer member.

5. In a door latch fitting as defined in claim 4 wherein said shank portion includes opposing flat sections, and said another pair of gripping tongues engage said opposing flat sections.

6. In a door latch fitting as defined in claim 1, wherein said rim portion includes an upturned circumferential flange extending part way around said retainer member to leave an arc of predetermined extent, said flange includes shoulders located at the ends of said arc to provide said stop surfaces for co-operating with the abutment means.

7. In a door latch fitting as defined in claim 6 wherein said abutment means comprises a stop lug on said base plate.

8. In a door latch fitting as defined in claim 6 wherein the shank portion includes a groove formed along its outer surface, and the axial position of the retainer member is to be located by the groove in the shank portion.

9. In a door latch fitting as defined in claim 6 wherein said shoulders are defined by integral extensions of said rim portion forming rearwardly directed ears having flat faces lying in radial planes.

10. In a door latch fitting as defined in claim 9 wherein the shank portion includes a groove formed along its outer surface, and the axial position of the retainer member is to be located by the groove in the shank portion.

11. In a door latch fitting as defined in claim 1 wherein the aperture periphery is of substantially rectangular form, and said rear end of the shank portion has a substantially rectangular cross-section.

12. In a door latch fitting as defined in claim 11 wherein the shank portion includes opposing flat sections and opposing groove portions each having a groove formed along its outer surface, a pair of opposing gripping tongues extend inwardly to be received by said grooves, and another pair of gripping tongues extend rearwardly to engage the flat sections to prevent rotation of said retainer member.

13. In a door latch fitting as defined in claim 11 wherein the shank portion includes a groove formed along its outer surface, and the axial position of the retainer member is to be located by the groove in the shank portion.

14. In a door latch fitting as defined in claim 11 wherein said rim portion includes an upturned circumferential flange extending part way around said retainer member to leave an arc of predetermined extent, said flange includes shoulders located at the ends of said arc to provide said stop surfaces for co-operating with the abutment means.

15. In a door latch fitting as defined in claim 11 wherein at least one integral gripping tongue extends from each side of said rectangular aperture periphery to closely embrace the rear end of the shank portion.

16. In a door latch fitting as defined in claim 15 wherein the shank portion includes a groove formed along its outer surface, and the axial position of the retainer member is to be located by the groove in the shank portion.

17. In a door latch fitting as defined in claim 15 wherein said rim portion includes an upturned circumferential flange extending part way around said retainer member to leave an arc of predetermined extent, said flange includes shoulders located at the ends of said arc to provide said stop surfaces for co-operating with the abutment means.

18. In a door latch lever handle fitting having a base plate and a lever handle including retaining means for rotatably securing a shank portion of the handle having a rear end to the base plate which is adapted to be secured to the face of a door, said retaining means comprising:

(a) a single, spring steel retainer member having a plate-like form including a shank portion contacting aperture periphery which its over the shank portion of the handle, (b) said retainer member including at least four tongues inclined rearwardly from said periphery including gripping tongues inclined inwardly from said periphery toward the central axis of said aperture, (c) said gripping tongues being pre-bent out of the general plane of the retainer member prior to assembly of said retainer member on said shank portion to permit said retainer member to be pushed onto said rear end of the shank portion, (d) said shank portion having a cross-sectional profile co-operable with said aperture periphery of said retainer member so that the shank portion is capable of being gripped by said tongues to restrain removal therefrom and prevent relative rotation between the shank portion and the retainer member, (e) said retainer member including a rim portion having a bearing surface which biasingly engages the base plate with an axial thrust when the fitting is assembled with the inwardly and rearwardly inclined tongues of the retainer member gripping the shank portion of the handle to urge the shank portion toward the base plate, (f) said fitting including abutment means and said retainer member including a circumferential arc portion defined by stop surfaces arranged on a circumferential flange extending part way around said retainer member to co-operate with the abutment means to locate the normal angular position of the handle and to limit the angular movement thereof with respect to the base plate.

19. In a door latch fitting as defined in claim 18 wherein the circumferential arc portion extends a shorter way around said retainer member than the circumferential flange.

20. In a door latch fitting having a lever handle including retaining means for rotatably securing a shank portion thereof to a base plate adapted to be secured to the face of a door, said retaining means comprising:

(a) a single, spring steel retainer member having a plate-like form including an aperture having a non-circular periphery, having a substantially rectangular form, (b) said retainer member including eight tongues including integral gripping tongues inclined inwardly and rearwardly from said periphery toward the central axis of said aperture, (c) said shank portion having a rear end and a substantially rectangular cross-sectional profile co-operable with said non-circular aperture periphery so that the shank portion is capable of being gripped by said tongues to restrain removal therefrom and rotation relative thereto, (d) said gripping tongues being bent out of the general plane of the retainer member to permit said retainer member to be pushed onto said rear end of the shank portion, (e) two of the integral gripping tongues extend from each side of the rectangular aperture to closely embrace the rear end of the shank portion, (f) said retainer member including a rim portion having a bearing surface to biasingly engage the base plate so that when said fitting is assembled the retainer member gives an axial thrust and urges the shank portion toward the base plate, (g) said fitting including abutment means and said retainer member including stop surfaces arranged to co-operate with the abutment means to locate the normal angular position of the handle and to limit the angular movement thereof with respect to the base plate, (h) two of the gripping tongues extend generally at 90° to said retainer member and which in use lie parallel to the axis of the shank portion, (i) said two tongues arranged on opposed sides of the shank portion being offset from one another.

21. In a door latch fitting as defined in claim 20 wherein the shank portion includes a groove formed along its outer surface, and the axial position of the retainer member is to be located by the groove in the shank portion.

22. In a door latch fitting as defined in claim 20 wherein said rim portion includes an upturned circumferential flange extending part way around said retainer member to leave an arc of predetermined extent, said flange includes shoulders located at the ends of said arc to provide said stop surfaces for co-operating with the abutment means.

23. In a door latch fitting as defined in claim 22 wherein the shank portion includes a groove formed along its outer surface, and the axial position of the retainer member is to be located by the groove in the shank portion.

24. In a door latch fitting as defined in claim 22 wherein said shoulders are defined by integral extensions of said rim portion forming rearwardly directed ears having flat faces lying in radial planes.

25. In a door latch fitting as defined in claim 22 wherein the shank portion includes a groove formed along its outer surface, and the axial position of the retainer member is to be located by the groove in the shank portion.

* * * * *